United States Patent [19]

Johnson

[11] 4,144,990

[45] Mar. 20, 1979

[54] HIGH SPEED CAM ROLL LIFTER FOR PRESS FEEDER

[75] Inventor: Kenneth C. Johnson, Des Plaines, Ill.

[73] Assignee: F. J. Littell Machine Company, Chicago, Ill.

[21] Appl. No.: 850,971

[22] Filed: Nov. 14, 1977

[51] Int. Cl.[2] ..... B65H 17/22

[52] U.S. Cl. ..... 226/154; 226/156; 226/176; 226/187

[58] Field of Search ..... 226/154, 155, 156, 176, 226/177, 181, 186, 187

[56] References Cited

U.S. PATENT DOCUMENTS

| | | | |
|---|---|---|---|
| 3,493,159 | 2/1970 | Balunas | 226/154 X |
| 3,638,846 | 2/1922 | Wiig | 226/156 X |
| 3,647,127 | 3/1972 | Wiig | 226/155 |
| 4,029,251 | 6/1977 | Johnson | 226/181 X |

*Primary Examiner*—Richard A. Schacher
*Attorney, Agent, or Firm*—Russell H. Clark

[57] ABSTRACT

In the apparatus as herein disclosed, the strip material passes between a lower driven roll and an upper idler roll which is mounted on a vertically adjustable bracket member that maintains a square position at all times since it is trapped between the main support members of the housing. When the clamp screws are loosened the bracket will not cock or misalign. The upper idler roll is pivotally mounted on the bracket member for movement to and from the lower driven roll and pressure means in the form of an air bag is associated with the idler roll pivot arm, having a location outwardly beyond the idler roll.

3 Claims, 8 Drawing Figures

106
53
75
54
90
117
81
110
96
98
120
86
126
81
70
93
74
130
103

HIGH SPEED CAM ROLL LIFTER FOR PRESS FEEDER

The invention relates to roll feeding mechanism for intermittently feeding strip material in desired lengths to a forming press, a punch press or similar machine and has reference in particular to an improved high speed roll lifter mechanism for periodically lifting the idler roll from an intermittently rotating feed roll, whereby to release the strip material located between the rolls following a feeding operation.

An objective of the invention is to provide a high speed roll lifting mechanism wherein the upper idler roll of a feeding couple is mounted for bodily pivotal movement on a vertically slidable and adjustable idler roll supporting bracket, whereby the idler roll can be adjusted bodily in a vertical direction to and from the lower driven roll without distrubing the action of the air bag in biasing the idler roll towards the lower roll and without disturbing the action or timing of the actuating cam which periodically produces a lifting of the idler roll against the pressure of the air bag.

Another object of the invention resides in the provision of improved roll lifter mechanism incorporating a vertically adjustable bracket, a lifter arm pivotally carried thereby and an air bag also carried by the bracket and wherein the mechanism and associated parts are capable of high speeds during operation by reason of the selective positioning of the parts, the co-action of certain parts with others and the high efficiency which is obtained by operation of all the parts in combination.

Another object of the invention resides in the provision of improved roll lifter mechanism capable of high speeds and wherein the vertically adjustable lifter roll bracket is mounted by gibs on the framework, wherein the cam actuated lifter arm is pivotally supported by the bracket for actuation at one end by a cam that can be angularly adjusted or replaced with one having different characteristics, and wherein the other end of the lifter arm has contact with an air bag so that the pressure of the air bag will force the idler roll into contact with the lower intermittenly driven feed roll.

An additional object is to provide an improved, high speed roll lifter mechanism which will include a gear housing for the incoming driving shaft and which will house a pair of bevel gears arranged to drive a single shaft that extends in opposite directions for driving at one end a conjugate cam arrangement which produces the intermittent rotation of the lower feed roll, and for driving at its opposite end the actuating cam for producing the lifting action of the idler roll.

A further object is to provide apparatus of the character described which will be capable of speeds better than that possible with the apparatus shown and claimed in my U.S. Pat. No. 4,029,251 granted June 14, 1977 and entilted Roll Feed With Modular Roll Lifter Mechanism.

In the drawings which illustrate one embodiment of the invention and wherein like reference characters are used to designate like parts;

Figure 2:
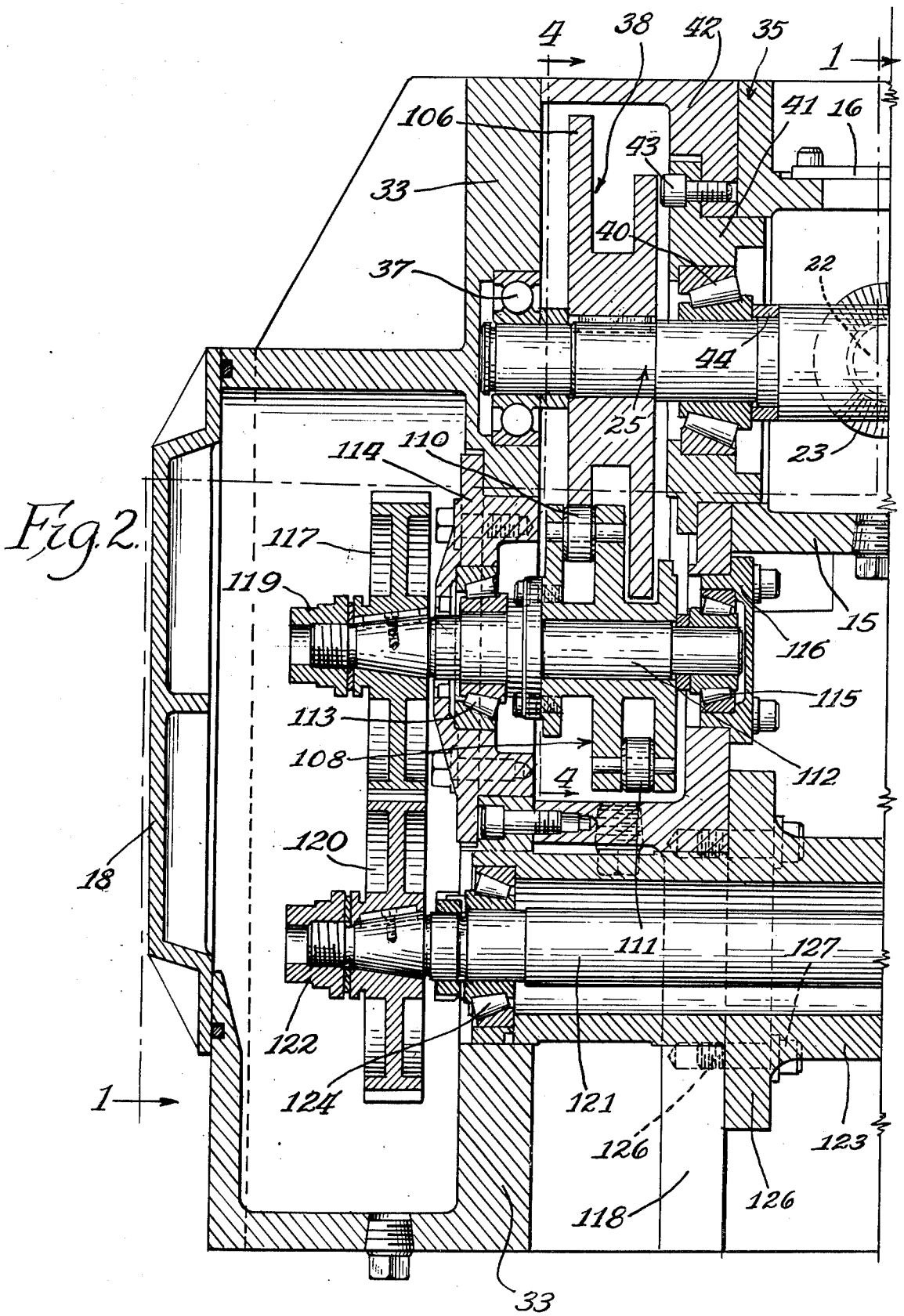
FIG. 2 is a sectional view taken substantially on line 2—2 of FIG. 1 and showing the half section of the apparatus which houses the conjugate cam, the cam follower, and gear drive for the lower feed roll.
Figure 4:
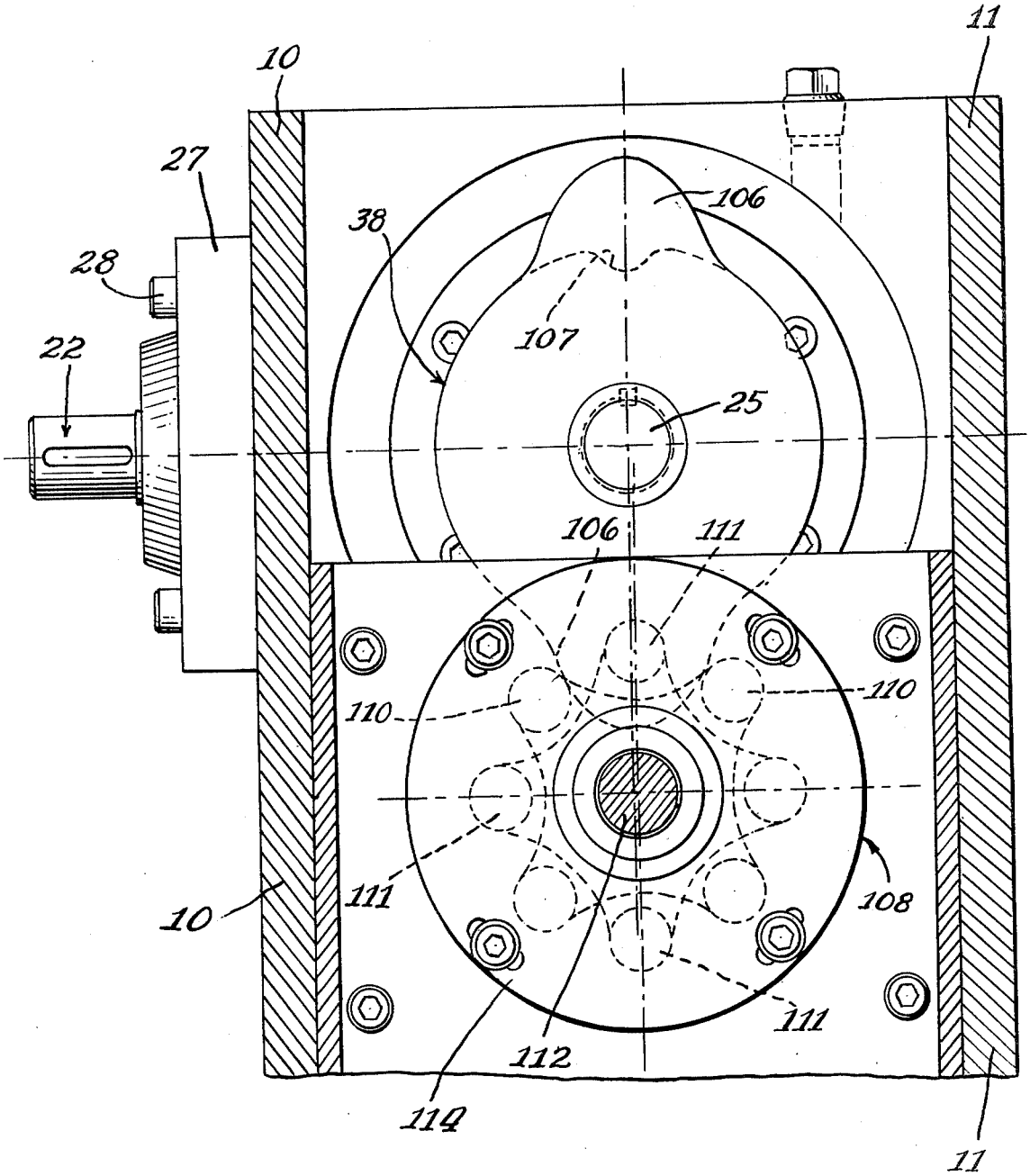
Figure 5:
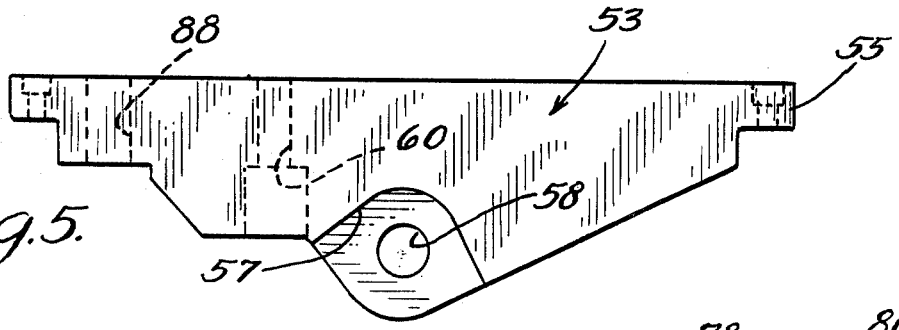
Figure 6:
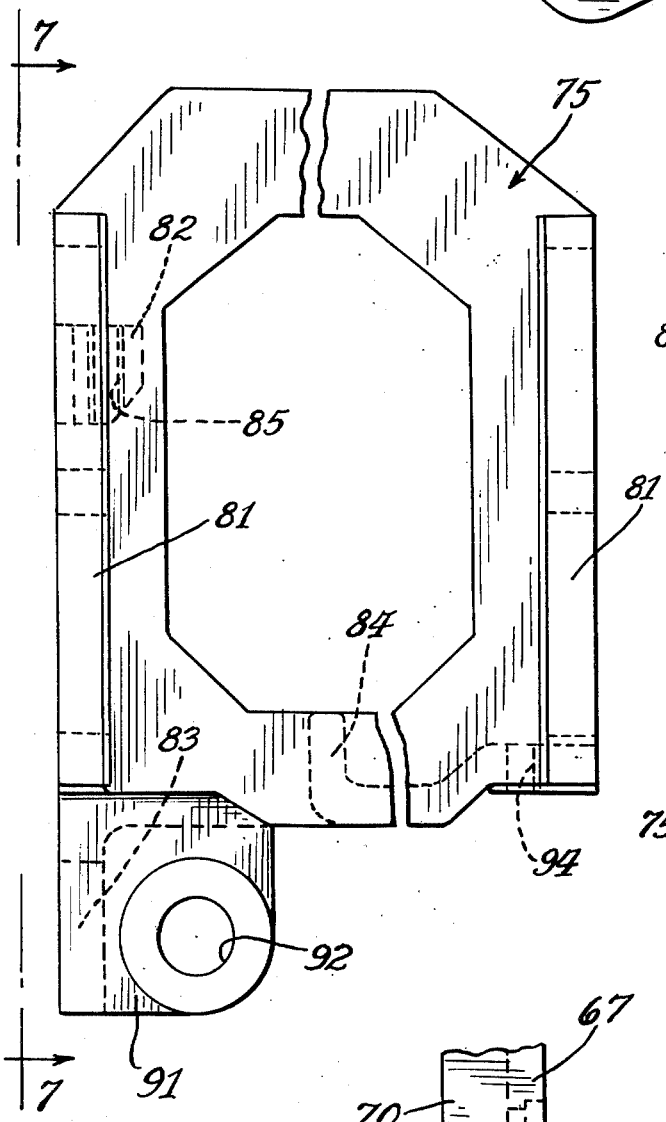
Figure 7:
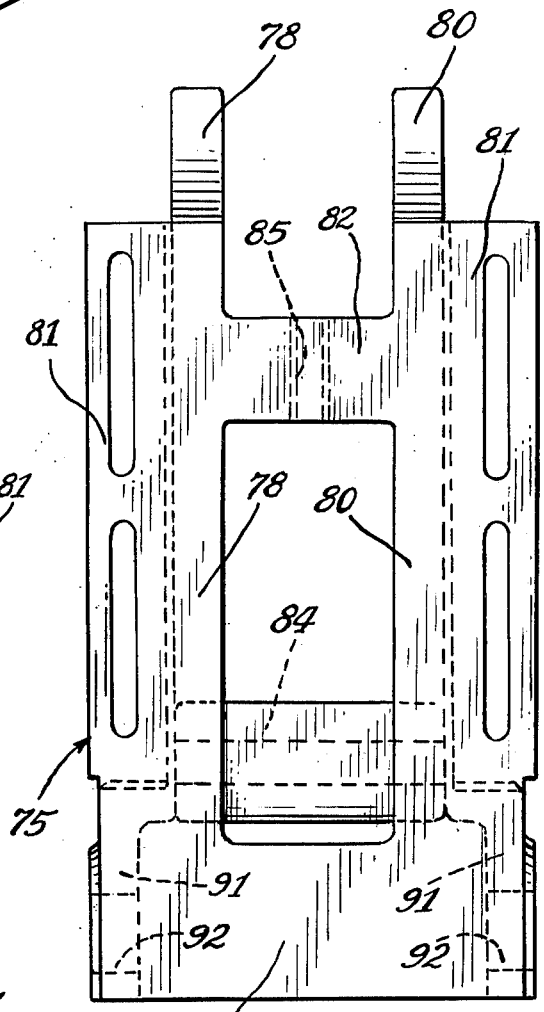
Figure 8:
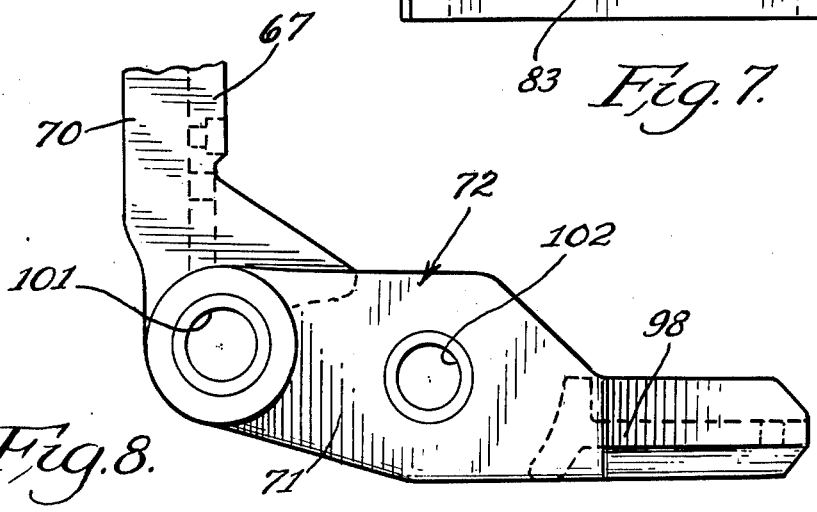
Figure 9:
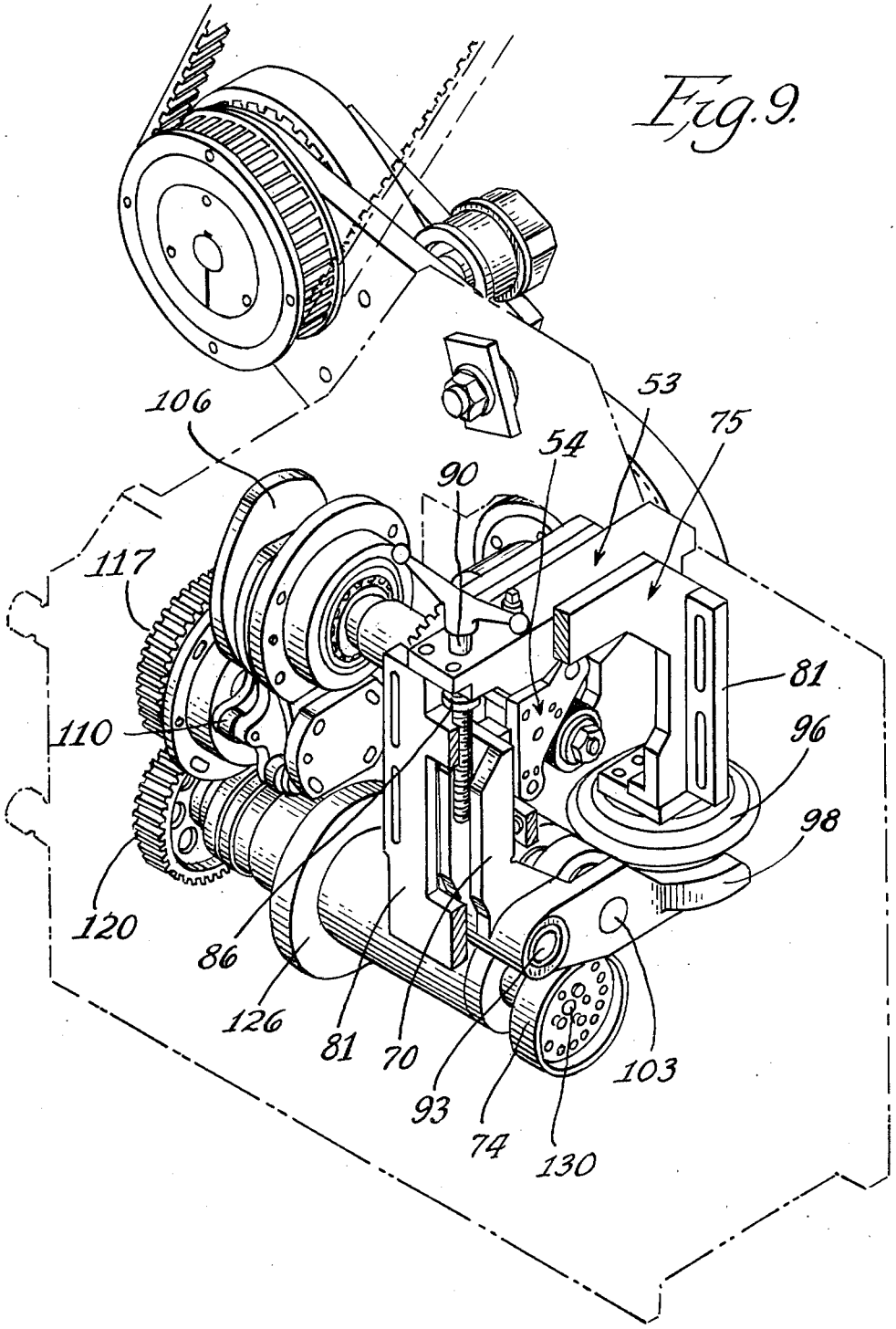

FIG. 4 4 is a sectional view taken substantially on line 4—4 of FIG. 2 and illustrating the conjugate cam arrangement for intermittently rotating the lower feed roll;

FIG. 5 is a front elevational view of the top supporting member;

FIG. 6 is a front elevational view of the idler roll adjusting bracket;

FIG. 7 is an end view of the idler roll adjusting bracket, taken substantially on line 7—7 of FIG. 6 and looking in the direction of the arrows;

FIG. 8 is a front elevational view of the pivotally supported idler roll lifter arm, and FIG. 9 is an averall assembly view showing in perspective the present high speed cam roll lifter mechanism with all the parts in operative relation.

Figure 1:
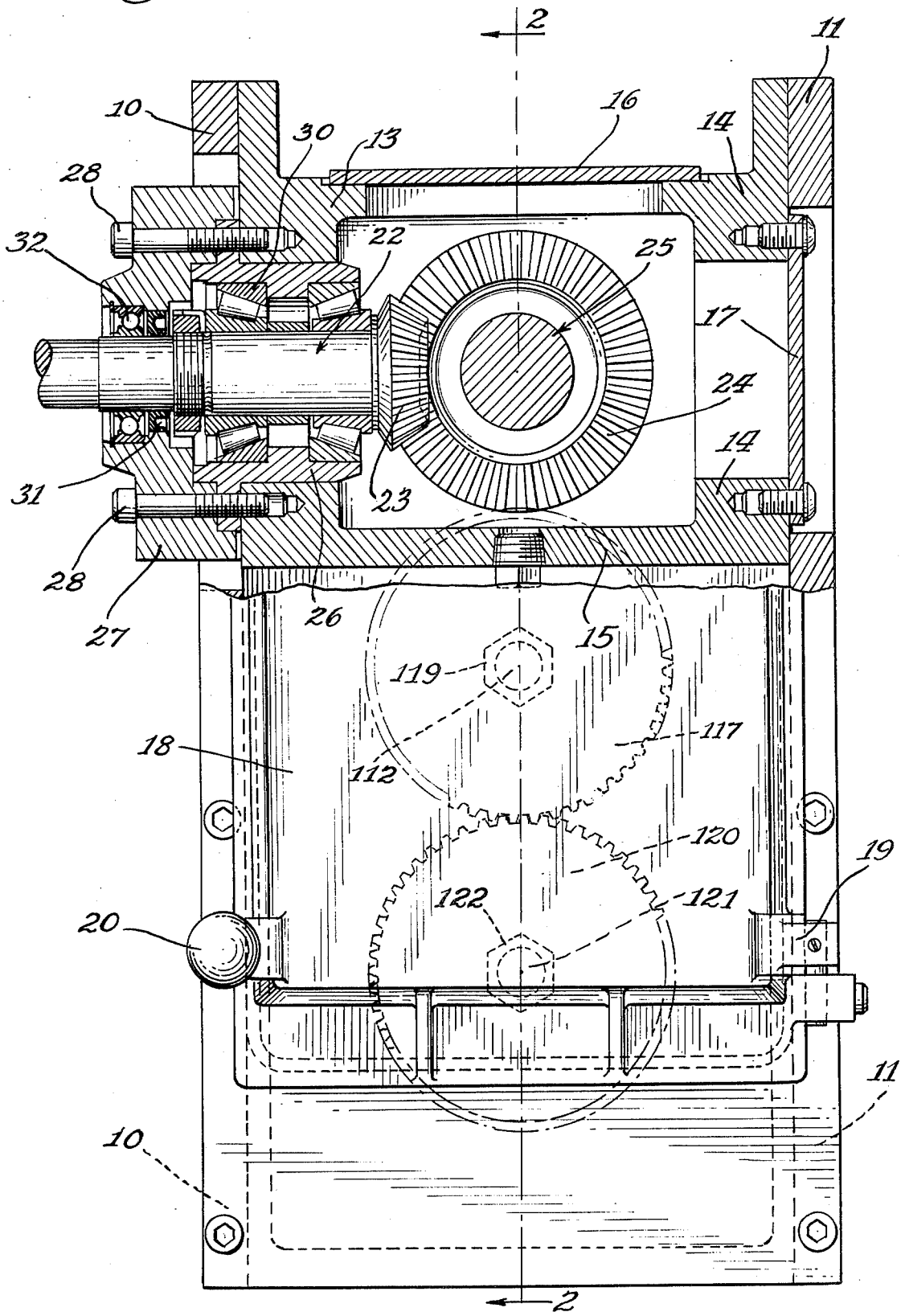
FIG. 1 is a view, partly in section and partly in elevation, taken subatantially on line 1—1 of FIG. 2 and showing the input driving shaft and associated parts.

Referring to the FIGS. 1, 2, 2A and 3, the frame structure of the present apparatus includes the rear and the front frame members 10 and 11 connected by the cross tie 12, the members extending from the base to the top and which provide supporting means for a bevel gear housing formed in part by the walls 13 and 14 and by the bottom wall 15. The top opening in wall 13 is closed by the plate 16 and plate 17 closes the opening in wall 14. The lower part of the frame structure shown in FIG. 1 is provided with a door 18 pivotally supported on hinges 19 and having a knob 20, making it convenient for the operator to open the door when he desires access to the conjugate cam arrangement and the gears driven thereby.

Figure 2A:
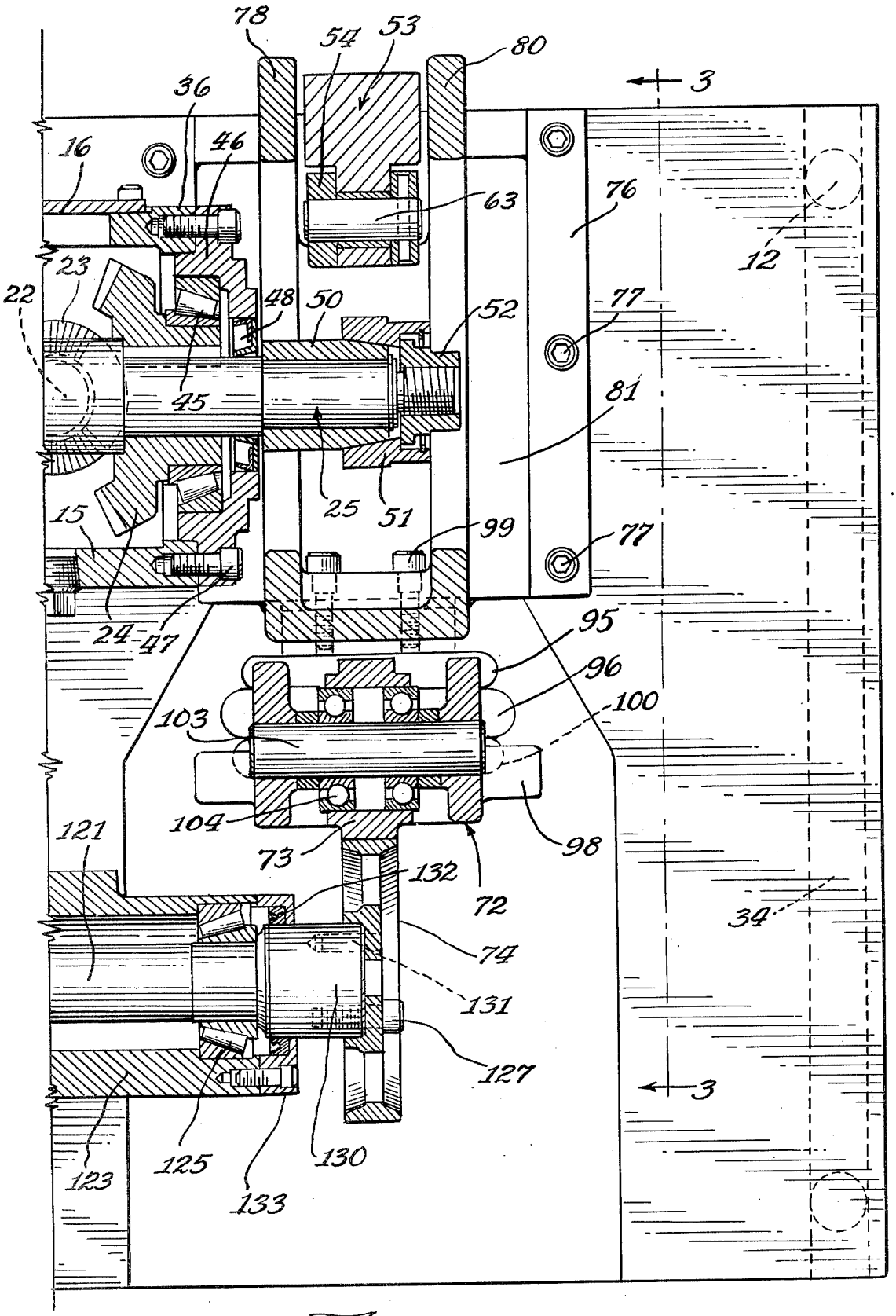
FIG. 2A is a sectional view also taken on line 2—2 of FIG. 1 and which shows the other half section of the apparatus housing the roller equipped pivot lever, the idler roll adjusting bracket, the lifter arm and the air bag.

The wall 13 retains the journalling means for the input driving shaft 22 having the bevel gear 23 fixed to its terminal end, which gear suitably meshes with another bevel gear 24 on the single, horizontally mounted drive shaft numbered 25, FIG. 2 and 2A. The journalling means for the input shaft 22 includes the flanged, cylindrical member 26 fitting within an opening in wall 13 and the retaining member 27 which is held in place by the screws 28 that pass through the flanges on the member 26 and into the wall for securement. The member 26 provides the tapered bearings 30 for shaft 22 and the retaining member provides the oil seal 31 and the ball bearing 32.

The bevel gear 23 fixed to the input driving shaft 22, meshes with bevel gear 24 fixed to the single, horizontally mounted drive shaft 25. Said drive shaft extends from side wall 33 to the opposite side wall 34 and this main drive shaft for the present apparatus drives different instrumentalities at respective ends. At the left hand end as shown in FIG. 2 the shaft 25 drives the conjugate cam arrangement which in turn produces the intermittent rotation of the lower feed roll and at its right hand end said shaft 25 actuates certain pivoted arms to cause a periodic lifting of an upper idler roll from its driven feed roll.

The said drive shaft is mounted for rotation at each end by bearings certain of which are located in the side wall 35 and 36 of the bevel gear housing which is completed by the front and rear walls 13 and 14 previously identified. At the extreme left hand end, the shaft 25 is journalled by the ball bearing 37 suitably mounted in wall 33 and adjacent the bearing the shaft carries the conjugate cams identified in their entitety by 38. See FIG. 4. An additional bearing is provided at the right side of the cam unit, namely the roller bearing 40 which is carried by the bearing retainer 41 having interfitting relation in the intermediate wall 42, said wall in turn having facing relation with wall 35 of the bevel gear housing. The bearing retainer enters aligned openings in walls 42 and 35, being secured by the screws 43 to wall 42 and the structure thus accomodates the shaft and in addition to journalling the shaft the retainer also positions the shaft by reason of the interposed ring 44.

The right hand portion of shaft 25 has the bevel gear 24 keyed thereto and the said gear and shaft are journalled by the roller bearing 45. The bearing is carried by the retainer 46 having an interfitting mounting in wall 36 of the bevel gear housing and being secured in place by the screws 47. This right hand of shaft 25 is provided with an oil sealing ring 48 and at its reduced end the shaft carries the tapered bushing 50. The actuating cam 51, for producing the lifting actions of the idler roll, is conveniently fitted on the tapered end of the bushing 50 and the assembly is held on the shaft 25, with the cam 51 in desired angular position, by the threaded nut 52. By releasing the nut the cam is released and the same can be rotatively adjusted and then held in its new position by again tightening the nut 52. As previously mentioned the cam 51 through two pivot members effects actuation of the idler roll to lift the same from the lower feed roll, all in a manner which will now be described.

Figure 3:
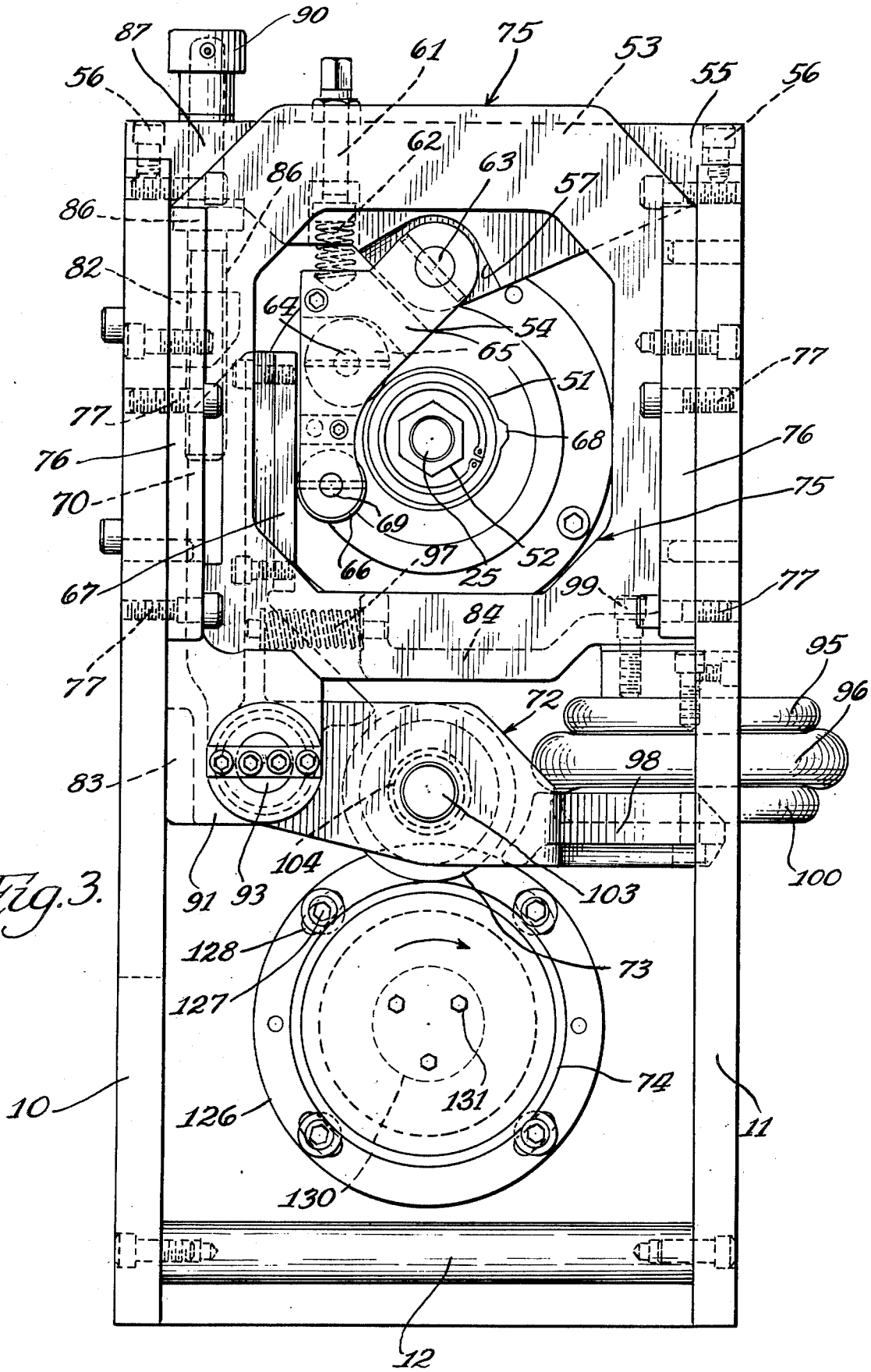
FIG. 3 is a view, taken substantially on line 3—3 of FIG. 2A, all parts being shown in elevation, including the top supporting member, the roller equipped pivot lever, the idler roll adjusting bracket, the lifter arm and the air bag.

The actuating cam, the pivot members, the adjusting bracket and the air bag are best shown in FIG. 3, wherein it will be observed that walls 10 and 11 have secured to their extreme upper ends a support member 53 for pivotally supporting the roller equipped pivot lever 54. As shown in FIG. 5, the support member has the extensions 55 at each end and which seat on the flat top surfaces of the walls 10 and 11 and which receive the screws 56 for securing the support member in place. Said member has the general shape of an inverted triangle with a semi-circular recess 57 on each side in the vicinity of the apex. The web thus formed has the opening 58 therein and the member also has the cored opening 60 to receive the screw element 61. A coil spring 62 extends between the base end of the screw element and the horizontal ledge on the pivot lever 54 for biasing the lever in a counter-clockwise direction, said lever being pivotally supported in member 53 by the pivot pin 63 located in the opening 58. This pivot end of lever 54 is bifrucated to receive the center web formed by the side recesses 57 as shown in FIG. 2A, and in this manner the pivot lever is pivotally carried by the support member.

The pivot lever carries two rollers, namely 65 and 66, the roller 65 being rotatably mounted on the pivot lever about centrally by the stud shaft 64 and the second roller 66 being mounted adjacent the bottom rounded end of the lever by the stud shaft 69. Roller 65 is maintained in contact with the actuating cam 51 by the coil spring 62 which yieldingly forces the lever in a counter-clockwise direction. The roller 66 is normally in contact with the wear plate 67 fixed to the upright leg of the idler roll lifter arm 72. The cam 51 has a high portion 68 formed on its periphery and which contacts the roller 65 on each revolution of the cam to rock the pivot lever in a desired clockwise direction and thus the roller 66 is caused to move the wear plate 67 to the left and in turn rock the idler roll lifter arm 72. Accordingly it will be understood that the idler roll lifter is actuated to lift the idler roll 73 from contact with the lower feed roll 74 at periodic times during each revolution of the cam 51.

In accordance with the invention the idler roll lifter arm is pivotally carried by an adjusting bracket 75, FIGS. 6 and 7, which is vertically slidable on the frame structure being mounted for adjustment by the gibs 76 secured to the frames by the screws 77. Said bracket is substantially square in outline and the same consists of two frame pieces 78 and 80 each being provided with the side extensions 81 which slide on the gibs 76. Also the frame pieces are joined at several locations by the webs 82, 83 and 84. The web 82 has an opening 85 preferably threaded for receiving the screw part 86 of a jack screw arrangement provided by the stem 87 which passes through the opening 88 in the support member 53 and has the knob 90 fixed thereto. Accordingly the operator by turning the knob can actuate the jack screw 86 and move the bracket vertically either up or down until a desired operating position is obtained. Web 83 is located in the vicinity of the bifrucated, depending hinge members 91 which are apertured at 92 for receiving the pivot pin 93, the said pin pivotally mounting the idler roll lifter arm 72 on the bracket. Web 84 extends to the right and has an opening 94 which receives a securing screw 99 for securing the backing plate for the air bag to this part of the bracket, said plate being identified by 95 and the air bag by 96. The upstanding part of web 84 helps to contain a coil spring 97 between the same and the vertical leg 70 of the lifter arm, said leg extending vertically upward from the pivot axis 93 and having the wear plate 67 secured thereto for providing a contact surface for the roller 66.

The lifter arm 72 for the idler roll 73 is best shown in FIG. 8 which illustrates the arm as substantially L-shaped having the vertical leg 70 and a horizontal leg 71. The leg 70 carries the wear plate and the leg 71 is fashioned by the part 98 for supporting the plate 100 secured thereto and which also has contact with the air bag 96. The opening 101 receives the pivot pin 93 and thus the lifter arm is pivotally carried by the bracket and is moved up and down when the bracket is adjusted vertically by the jack screw arrangement. The opening 102 receives the journalling pin 103 and said pin conveniently journals the idler roll 73 by means of the ball bearings 104, FIG. 2A. The idler roll co-acts with the lower feed roll 74 to form a feeding couple for feeding strip material, and to understand the intermittent cam drive for the lower feed roll reference is made to the FIGS. 2 and 4.

The cam member of the conjugate cam arrangement is shown in FIG. 4 as comprising a dual cam element each having a lobe 106 and a semi-circular depression 107 with the circumference between being circular. Each cam element is adapted to co-act with a cam follower 108, the same carrying rollers 110 and 111 respectively. The rollers are spaced equal distance around its cam follower in staggered relation as regards the followers. The cam member 38 is fixed on shaft 25 and has continuous rotation during operation of the apparatus. When the lobe of a cam element enters between a pair of rollers such as 110 it imparts rotation to the follower. However when the lobe moves out of contact with the rollers, the follower unit remains at rest and which continues until the other lobe enters between the next pair of rollers. Thus the desired intermittent rotation of the follower unit is obtained since the lobes are spaced 180 degrees apart. A roller enters one of the depressions 107 when a lobe is in actuating contact with a pair thus maintaning control and eliminating clearances in the structure.

The cam follower unit 108 is fixed on the cam follower shaft 112 which is journalled at its respective ends, such as by the roller bearing 113 at the left hand end which is provided by the retainer 114 secured to wall 33. At the right hand end the shaft 112 is journalled by the roller bearing 115 provided by the retainer 116, suitably secured in place in the intermediate wall 118. The end of cam follower shaft extending beyond retainer 114 is substantially cone shaped to receive the gear wheel 117 which is keyed to the shaft and held by the threaded nut 119. Gear wheel 117 has meshing relation with a similar gear wheel 120 which is keyed to so as to drive the lower feed roll shaft 121. Said shaft is tapered at its left hand end for receiving the gear wheel 120 held on the shaft by the nut 122. Said shaft 121 is journalled in the tubular part 123 by the bearings 124 and 125, said tubular part being retained in wall 33 and in passing through wall 118 the circular member integral with the tubular part has facing relation with said wall 118 and is secured thereto by the screws 127. The screws pass through openings 128 in the circular member 126 and as a result the tubular part 123 can be adjusted in a rotative direction. The shaft 121 at its right hand end is enlarged in diameter to form the portion 130 to which is secured the lower feed roll 74 by the screws 131. An oil sealing ring 132 encircles the enlarged portion and the same is held in place by the retainer 133.

A feature of the present apparatus resides in the provision of the single, horizontally mounted drive shaft 25 which drives different mechanisms at its respective ends, and which eventially have co-acting relation as evidenced by the upper idler roll 73 and the lower feed roll 74. The lifting action of the idler roll takes place periodically to release the grip on the strip material being fed by the feeding couple 73 and 74. This releasing action which is produced by the high portion 68 on cam 51 can be varied by changes in the height of portion 68 and by changes in its angular extent, the former controlling the degree of the lifting action and the latter controlling the duration of the lift. In the present apparatus the air bag 96 is relatively close to the idler roll and thus the pressure exerted by the air bag is conveniently applied by the idler roll to produce the bite on the strip material passing between the feeding rolls. By means of the jack screw arrangement 86 the bracket 75 can be vertically adjusted to obtain the most advantageous positioning of the idler roll with respect to the lower feed roll. Any such adjustment of the bracket 75 can be made without disturbing the action of the lifter arm 72 or without disturbing the timing of such action.

The drive from the press to the input shaft 22 of the present apparatus, as shown in FIG. 9, may comprise the timing belt 135 which passes around the timing sprocket 136 on the stud shaft 137. The stud shaft is part of an elbow arrangement which addittionally includes the part 138 and a second timing belt 140. Accordingly the press conveniently drives the input shaft previously described in connection with FIG. 1.

The idler roll adjusting bracket 75 of the invention will maintain a square position at all times because it is trapped between the main support members 10 and 11. If the clamp screws are loosened, the adjusting bracket will not cock or misalign. The improved apparatus also incorporates an air bag 96 which is mounted on the idler roll lifter arm 72 on the same side as the roll 73 in relation to the arm pivot shaft 93. This is an advantage since if there are any plastic characteristics between the lever and pivot compared to the pivot and roll, the responsiveness of the idler roll is not diminished. The air bag has the additional advantage of functioning as a vibration and noise absorber. The number of impacts inherent with the rotating cam striking cam followers in turn striking the roll lifter arm, need to be absorbed by something. The air bag assists in such absorption.

I claim:

1. In roll feeding apparatus, in combination with a pair of rolls including a lower feed roll and an upper idler roll, of frame structure providing journalling means for a horizontally disposed main drive shaft adapted to rotate continuously during operation, a conjugate cam unit fixed on said shaft at one end, a secondary shaft journalled by a tubular member forming part of the frame structure and having the lower feed roll fixed thereon at one end, means connecting the conjugate cam unit with said secondary shaft for driving the secondary shaft intermittently, an actuating cam releasably fixed to the drive shaft at its end opposite the conjugate cam unit, a bracket slidably mounted by the frame structure for vertical adjustment, a pivot arm pivotally carried by the bracket and said arm having the upper idler roll journalled thereon, means operatively connecting the actuating cam with the pivot arm whereby the arm is actuated to lift the upper idler roll in a vertical direction away from the lower feed roll for each revolution of the actuating cam, and an air bag provided by the bracket and positioned so that the end of the pivot arm beyond the idler roll has contact with the air bag, whereby said lifting action of the pivot arm takes place against the pressure exerted by the air bag.

2. Roll feeding apparatus as defined by claim 1, additionally including a jack screw member depending from the frame structure and having threaded engagement with the bracket for adjusting the vertical position of the bracket with respect to the lower feed roll, and additionally including a wear plate interposed in the means operatively connecting the actuating cam with the pivot arm.

3. In roll feeding apparatus for intermittently feeding atrip material, in combination with a lower feed roll and an upper idler roll, of frame structure providing a gear housing, a driving shaft entering the housing from the rear and having a bevel gear fixed thereon, a main drive shaft extending from side to side of the frame structure and through the gear housing to be journalled by the housing, a second bevel gear fixed to the main drive shaft and having meshing relation with the first mentioned bevel gear, conjugate cam elements mounted on the drive shaft at one end and operative to drive the lower feed roll in an intermittent manner, an actuating cam fixed to the main drive shaft at its other end, a pivot arm carrying the upper idler roll above and in vertical alignment with respect to the lower feed roll, means operatively connecting the actuating cam with said pivot arm and effective to actuate the arm on each revolution of the cam to cause a lifting of the idler roll in a direction away from the lower feed roll, and an air bag positioned for contact with the pivot arm at the extreme end of the arm and adjacent the idler roll, whereby the lifting of the idler roll in a direction away from the feed roll takes place against the pressure exerted by the air bag.

* * * * *